US008313286B2

(12) United States Patent
Beeck

(10) Patent No.: US 8,313,286 B2
(45) Date of Patent: Nov. 20, 2012

(54) DIFFUSER APPARATUS IN A TURBOMACHINE

(75) Inventor: Alexander R. Beeck, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 939 days.

(21) Appl. No.: 12/393,555

(22) Filed: Feb. 26, 2009

(65) Prior Publication Data

US 2010/0021291 A1 Jan. 28, 2010

Related U.S. Application Data

(60) Provisional application No. 61/084,079, filed on Jul. 28, 2008.

(51) Int. Cl.

| | |
|---|---|
| ***F03D 11/00*** | (2006.01) |
| ***F04D 29/44*** | (2006.01) |
| ***F04D 29/54*** | (2006.01) |
| ***F03B 1/00*** | (2006.01) |
| ***F03B 11/02*** | (2006.01) |

(52) U.S. Cl. ..... 415/119; 415/211.2; 415/208.2; 415/148

(58) Field of Classification Search ..... 415/119, 415/211.2, 224.5, 150, 208.1, 157, 208.3, 415/158, 159, 208.2, 148, 208.4, 207, 209.1, 415/210.1, 225, 22, 226

See application file for complete search history.

(56) References Cited

U.S. PATENT DOCUMENTS

| | | | | |
|---|---|---|---|---|
| 3,300,121 | A | 1/1967 | Johnson | |
| 3,625,630 | A | 12/1971 | Soo | |
| 3,739,872 | A | 6/1973 | McNair | |
| 3,978,664 | A | 9/1976 | Parker et al. | |
| 4,272,955 | A | 6/1981 | Hoffman et al. | |
| 4,308,718 | A | 1/1982 | Mowill | |
| 4,512,158 | A | 4/1985 | Striebel et al. | |
| 4,802,821 | A | 2/1989 | Krietmeier | |
| 4,979,361 | A | 12/1990 | Clark et al. | |
| 5,338,155 | A | 8/1994 | Kreitmeier | |
| 5,340,276 | A | 8/1994 | Norris et al. | |
| 5,813,828 | A | 9/1998 | Norris | |
| 6,261,055 | B1 | 7/2001 | Owczarek | |
| 6,347,921 | B1 * | 2/2002 | Watanabe et al. | 415/211.2 |
| 6,488,470 | B1 * | 12/2002 | Owczarek | 415/148 |
| 6,513,330 | B1 | 2/2003 | Rice et al. | |
| 6,866,479 | B2 | 3/2005 | Ishizaka et al. | |
| 2004/0211185 | A1 | 10/2004 | Young et al. | |

FOREIGN PATENT DOCUMENTS

| | | | |
|---|---|---|---|
| EP | 0035838 | A1 | 9/1981 |
| EP | 1329595 | A1 | 7/2003 |
| EP | 1559874 | A1 | 8/2005 |
| WO | WO 2006/003071 | A1 | 1/2006 |

OTHER PUBLICATIONS

Smith, J.M. et al.; Performance of a Short Annular Dump Diffuser Using Suction-Stabilized Vortices at Inlet Mach Numbers to 0.41; NASA Technical Paper 1194; Apr. 1978; pp. 1-38; Lewis Research Center; Cleveland, Ohio.

* cited by examiner

*Primary Examiner* — Chuong A. Luu

(57) ABSTRACT

A diffuser apparatus in a turbomachine is provided comprising a diffuser structure and stabilizing structure. The diffuser structure includes inner and outer walls defining a flow passageway through which gases flow and diffuse such that kinetic energy is reduced and pressure is increased in the gases as they move through the passageway. The stabilizing structure stabilizes a separated gas recirculation zone.

20 Claims, 3 Drawing Sheets

DIFFUSER APPARATUS IN A TURBOMACHINE

This application claims the benefit of U.S. Provisional Application Ser. No. 61/084,079, entitled CARNOT DIFFUSER WITH DEVICES WHICH REDUCE SENSIBILITY TO INLET AND OUTLET FLOW CONDITIONS, filed Jul. 28, 2008, by Alexander Ralph Beeck, the entire disclosure of which is incorporated by reference herein.

FIELD OF THE INVENTION

The present invention relates to a diffuser apparatus in a turbomachine and, more particularly, to such a diffuser apparatus comprising a diffuser structure having a stepped section and stabilizing structure positioned downstream from the stepped section to stabilize a separated gas recirculation zone.

BACKGROUND OF THE INVENTION

A conventional combustible gas turbine engine includes a compressor, a combustor, and a turbine. The compressor compresses ambient air. The combustor combines the compressed air with a fuel and ignites the mixture creating combustion products defining a working gas. The working gases travel to the turbine. Within the turbine are a series of rows of stationary vanes and rotating blades. Each pair of rows of vanes and blades is called a stage. Typically, there are multiple stages in a turbine. The rotating blades are coupled to a shaft and disc assembly. As the working gases expand through the turbine, the working gases cause the blades, and therefore the shaft and disc assembly, to rotate.

A diffuser may be positioned downstream from the turbine. The diffuser comprises a duct whose cross-sectional area increases with distance. Due to its increasing cross sectional area, the diffuser functions to decelerate the exhaust gases. Hence, the kinetic energy of the exhaust gases decreases while the pressure of the exhaust gases increases. The greater the pressure recovery before the exhaust gases exit the diffuser, the lower the exhaust gas pressure is at the last turbine stage. The lower the pressure at the last turbine stage, the greater the pressure ratio across the turbine and the greater the work from the turbine.

It is desirable to produce a large increase of pressure and decrease of exhaust gas flow velocity from the inlet to the exit of the diffuser. Diffusion within a diffuser can be reduced where gas flow separates from the diffuser walls. Hence, it is desirable to minimize gas flow separation from the walls of a diffuser.

SUMMARY OF THE INVENTION

In accordance with a first aspect of the present invention, a diffuser apparatus in a turbomachine is provided comprising a diffuser structure and first stabilizing structure. The diffuser structure includes inner and outer walls defining a flow passageway through which gases flow and diffuse such that kinetic energy is reduced and pressure is increased in the gases as they move through the passageway. The outer wall may have first and second axial sections and a stepped section joining the first and second axial sections. The first stabilizing structure is positioned downstream from the stepped section of the outer wall to stabilize a separated gas recirculation zone located downstream from the outer wall stepped section.

In one embodiment, the stabilizing structure may comprise a perforated plate extending radially from and circumferentially about the outer wall and positioned downstream from the outer wall stepped section to stabilize the separated gas recirculation zone located downstream from the outer wall stepped section.

In another embodiment, the stabilizing structure may comprise at least one suction tube extending through the outer wall and communicating with an area of the passageway downstream from the outer wall stepped section such that the separated gas recirculation zone located downstream from the outer wall stepped section is stabilized.

The diffuser structure may further comprise at least one strut extending between the inner and outer walls of the diffuser structure and wherein the at least one suction tube communicates with an area downstream from the at least one strut such that high velocity gases downstream from the at least one strut generate a suction in the at least one suction tube.

The outer wall second axial section may have an inner diameter greater than an inner diameter of the outer wall first axial section.

The inner wall may comprise a first axial section and a stepped section located downstream from the first section.

The diffuser apparatus may further comprise second stabilizing structure associated with the inner wall stepped section to stabilize a separated gas recirculation zone located downstream from the inner wall stepped section.

The second stabilizing structure may comprise, in one embodiment, a perforated plate positioned adjacent to the inner wall stepped section to stabilize the separated gas recirculation zone located downstream from the inner wall stepped section.

In another embodiment, the second stabilizing structure may comprise at least one Helmholtz damper associated with the inner wall stepped section to stabilize the separated gas recirculation zone located downstream from the inner wall stepped section.

In accordance with a second aspect of the present invention, a diffuser apparatus in a turbomachine is provided comprising a diffuser structure and stabilizing structure. The diffuser structure may have inner and outer walls defining a flow passageway through which gases flow and diffuse such that kinetic energy is reduced and pressure is increased in the gases as they move through the passageway. The inner wall may have a first axial section and a stepped section located downstream from the first section. The stabilizing structure may be associated with the stepped section to stabilize a separated gas recirculation zone located downstream from the stepped section.

DETAILED DESCRIPTION OF THE INVENTION

Figure 1:
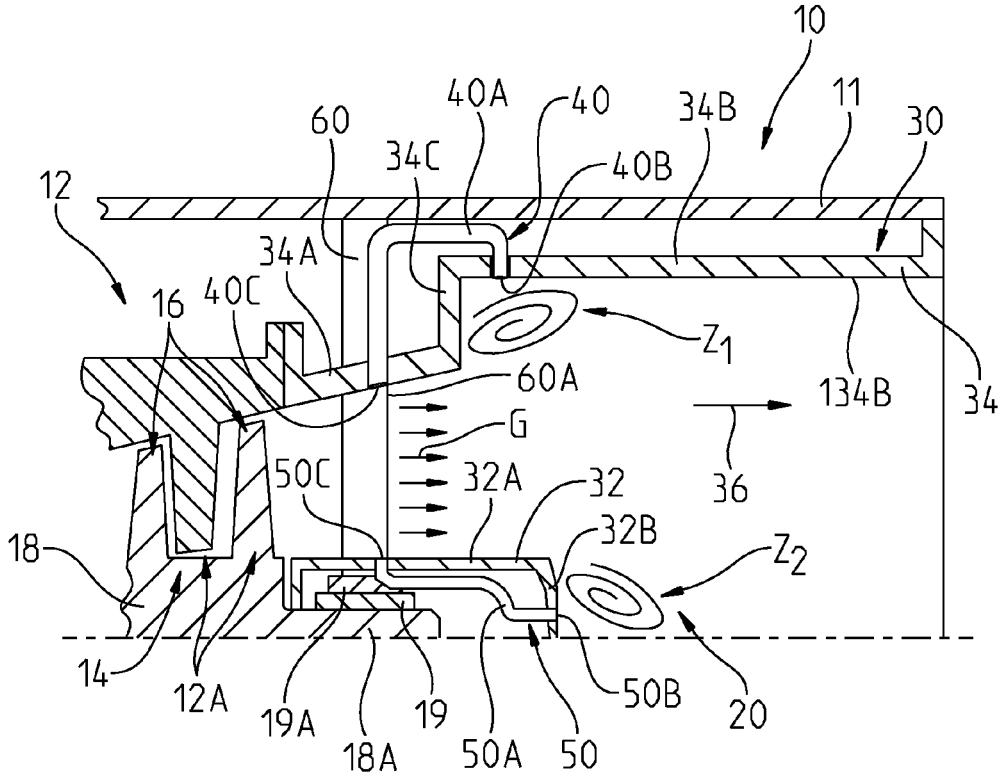
FIG. 1 is a schematic cross sectional view of a gas turbine engine including a diffuser apparatus constructed in accordance with a first embodiment of the present invention.

Embodiments of a diffuser apparatus, constructed in accordance with the present invention, for use in a turbomachine, are described below. Referring to FIG. 1, the turbomachine 10 may comprise a combustible gas turbine engine including an outer casing 11, a compressor (not shown), a combustor (not shown), and a turbine 12. The compressor compresses ambient air. The combustor combines the compressed air with a fuel and ignites the mixture creating combustion products defining a working gas. The working gases travel to the turbine 12. Within the turbine 12 are a series of rows of stationary vanes 14 and rotating blades 16. Each pair of rows of vanes and blades is called a stage. A last stage 12A in the turbine 12 is illustrated in FIG. 1. The rotating blades 16 are coupled to a shaft and disc assembly 18. As the working gases expand through the turbine, the working gases cause the blades 16, and therefore the shaft and disc assembly 18, to rotate. A shaft or rotor 18A of the shaft and disc assembly 18 is mounted for rotation within a bearing 19, e.g., a journal bearing. The bearing 19 is mounted to a stationary bearing housing 19A, which, in turn, is mounted to the outer casing via a plurality of struts 60.

In accordance with a first embodiment of the present invention, illustrated in FIG. 1, a diffuser apparatus 20 is positioned downstream from the turbine last stage 12A. The diffuser apparatus 20 comprises a diffuser structure 30 and first and second stabilizing structures 40 and 50. The diffuser structure 30 includes inner and outer walls 32 and 34 defining a flow passageway 36 through which exhaust gases G from the turbine 12 flow and diffuse. As the gases G diffuse in the diffuser structure 30, their kinetic energy is reduced while the pressure of the gases G increases.

The outer wall 34 comprises first and second axial sections 34A and 34B and a stepped section 34C joining the first and second axial sections 34A and 34B. The first axial section 34A may expand outwardly and the second axial section 34B has an inner diameter substantially larger than an inner diameter of the first section 34A. The inner wall 32 may comprise a first axial section 32A and a stepped section 32B located downstream from the first section 32A. The diffuser structure 30 has a shape similar to a known "dump diffuser." Only an upper portion of the diffuser structure 30 is schematically shown in FIG. 1.

Because the outer wall second axial section 34B has an inner diameter that is substantially larger than an inner diameter of the outer wall first section 34A and the increase in diameter between the first and second sections 34A and 34B occurs over a very small axial distance at the stepped section 34C, it is believed that the exhaust gases flowing through the passageway 36 form a first gas recirculation zone $Z_1$ or eddies just downstream from the stepped section 34C of the outer wall 34. The first gas recirculation zone $Z_1$ or eddies may extend substantially circumferentially near an inner surface 134B of the second section 34B. It is also believed that the exhaust gas flow may separate from the inner surface 134B of the outer wall second section 34B at locations adjacent or near the gas recirculation zone Z1. Limited or no diffusion of the exhaust gases may occur in regions of the diffuser structure 30 where the exhaust gas flow has separated from the inner surface 134B of the outer wall second section 34B, resulting in a reduction in efficiency of the diffuser structure 30 and the turbine 12. In the absence of the first stabilizing structure 40, it is believed that the gas recirculation zone $Z_1$ may be unstable, i.e., it may increase and decrease (i.e., oscillate) in size axially, circumferentially and/or radially over time during operation of the turbine 12. Any increase in the size of the gas recirculation zone $Z_1$ may result in a corresponding increase in the amount of gas flow separation at the inner surface 134B of the outer wall second section 34B. Further, oscillation in the size of the gas recirculation zone $Z_1$ consumes energy from the gases flowing through the diffuser structure 30, which is disadvantageous.

The first stabilizing structure 40 comprises one or a plurality of circumferentially spaced apart pipes 40A, each having a first end 40B extending through the outer wall second section 34B and positioned near the first gas recirculation zone $Z_1$ and a second end 40C extending through the outer wall first section 34A and being in communication with the passageway 36. As high velocity exhaust gases flow adjacent to and across the second end 40C of each pipe 40A, suction or a partial vacuum is created within the pipe 40A by the high velocity gases causing a portion of the exhaust gases defining the gas recirculation zone $Z_1$ to be removed via suction through the pipe first end 40B to reduce the flow field, thereby stabilizing, i.e., reducing the size and/or limiting changes in the size of the gas recirculation zone $Z_1$ axially, circumferentially and/or radially during operation of the turbine 12. The second end 40C of one or more of the pipes 40A may be positioned near a downstream side 60A of a corresponding strut 60 so that the exhaust gases removed from the first recirculation zone $Z_1$ may be deposited into a wake zone of the strut 60.

It is believed that exhaust gases flowing through the passageway 36 will generate a second gas recirculation zone $Z_2$ or eddies downstream of the stepped section 32B of the inner wall 32. In the absence of the second stabilizing structure 50, it is believed that the second gas recirculation zone $Z_2$ may be unstable, i.e., it may increase and decrease in size axially, circumferentially and/or radially over time during operation of the turbine 12. Any oscillation and/or increase in the size of the second gas recirculation zone $Z_2$ may result in energy losses within the exhaust gases G flowing through the passageway 36, thereby reducing the performance of the diffuser structure 30, i.e., the maximum pressure increase within the diffuser structure 30 is reduced or limited. As the diffuser structure performance decreases, the efficiency of the turbine 12 also decreases.

The second stabilizing structure 50 comprises one or more pipes 50A, each having a first end 50B extending through the inner wall stepped section 32B and positioned near the second gas recirculation zone $Z_2$ and a second end 50C extending through the inner wall first axial section 32A and being in communication with the passageway 36. As high velocity exhaust gases flow adjacent to and across the second end 50C of each pipe 50A, suction or a partial vacuum is created within the pipe 50A by the high velocity gases causing a portion of the exhaust gases defining the second gas recirculation zone $Z_2$ to be removed via suction through the pipe first end 50B to reduce the flow field, thereby stabilizing, i.e., reducing the size and/or limiting changes in the size of the second gas recirculation zone $Z_2$ axially, circumferentially and/or radially during operation of the turbine 12. The second end 50C of one or more of the pipes 50A may be positioned near the downstream side 60A of a corresponding strut 60 so that the exhaust gases removed from the second recirculation zone $Z_2$ may be deposited into a wake zone of the strut 60.

Figure 2:
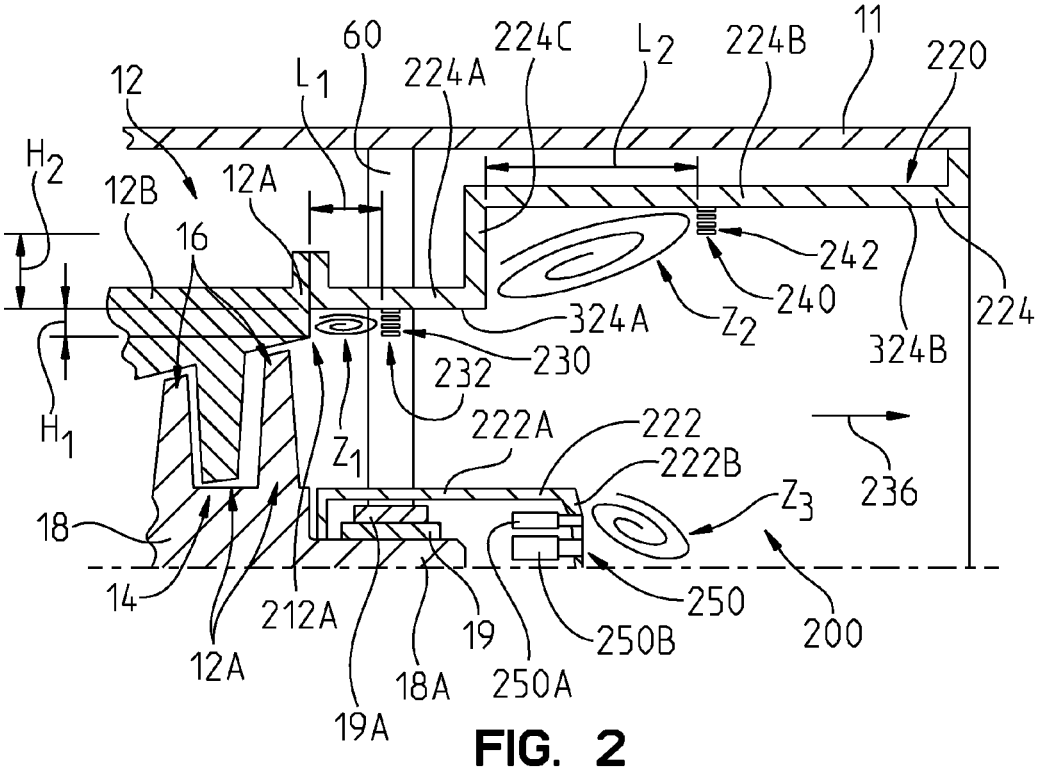
FIG. 2 is a schematic cross sectional view of a gas turbine engine including a diffuser apparatus constructed in accordance with a second embodiment of the present invention.

In accordance with a second embodiment of the present invention, illustrated in FIG. 2, a diffuser apparatus 200 is positioned downstream from the turbine last stage 12A. The diffuser apparatus 200 comprises a diffuser structure 220 and first, second and third stabilizing structures 230 and 240 and 250. The diffuser structure 220 includes inner and outer walls 222 and 224 defining a flow passageway 236 through which exhaust gases from the turbine 12 flow and diffuse. As the gases diffuse in the diffuser structure 220, their kinetic energy is reduced while the pressure of the gases increases. The outer wall 224 comprises first and second axial sections 224A and 224B and a stepped third section 224C joining the first and second axial sections 224A and 224B. The second axial section 224B has an inner diameter substantially larger than an inner diameter of the first section 224A.

It is noted that there is a stepped section 212A defined between an end 12A of a turbine outer wall 12B and the first axial section 224A of the outer wall 224.

The inner wall 222 may comprise a first axial section 222A and a stepped section 222B located downstream from the first section 222A. Only an upper portion of the diffuser structure 220 is schematically shown in FIG. 2.

Because a stepped section 212A is provided between the end 12A of the turbine outer wall 12B and the first axial section 224A of the outer wall 224, it is believed that the exhaust gases flowing through the passageway 236 form a first gas recirculation zone $Z_1$ or eddies just downstream from the stepped section 212A. Further, because the outer wall second axial section 224B has an inner diameter that is substantially larger than an inner diameter of the outer wall first section 224A and the increase in diameter between the first and second sections 224A and 224B occurs over a very small axial distance at the stepped section 224C, it is believed that the exhaust gases flowing through the passageway 236 form a second gas recirculation zone $Z_2$ or eddies just downstream from the stepped section 224C of the outer wall 224. The first gas recirculation zone $Z_1$ or eddies may extend substantially circumferentially near an inner surface 324A of the first section 224A while the second gas recirculation zone $Z_2$ or eddies may extend substantially circumferentially near an inner surface 324B of the second section 224B.

The exhaust gas flow may separate from the inner surfaces 324A and 324B of the outer wall first and second sections 224A and 224B at locations adjacent to or near the gas recirculation zones $Z_1$ and $Z_2$. Limited or no diffusion of the exhaust gases may occur in regions of the diffuser structure 220 where the exhaust gas flow has separated from the inner surfaces 324A and 324B of the outer wall first and second sections 224A and 224B, resulting in a reduction in efficiency of the diffuser structure 220 and also the turbine 12. Further, energy losses within the exhaust gas flow may occur as a result of the circulating flow of the gases within the first and second gas recirculation zones $Z_1$ and $Z_2$, which may further reduce the performance of the diffuser structure 220. In the absence of the first and second stabilizing structures 230 and 240, it is believed that the gas recirculation zones $Z_1$ and $Z_2$ may be unstable, i.e., they may increase and decrease in size axially, circumferentially and/or radially over time during operation of the turbine 12. Any oscillation and/or increase in the size of the gas recirculation zones $Z_1$ and $Z_2$ may result in a corresponding increase in the amount of gas flow separation at the inner surfaces 324A and 324B of the outer wall first and second sections 224A and 224B with an accompanying loss of energy in the exhaust gas flow.

The first stabilizing structure 230 comprises a perforated plate or grid 232 extending radially from and circumferentially about the inner surface 324A of the outer wall first section 224A. The openings or perforations in the plate 232 may have a radial size of from about 5% to about 30% of a radial height $H_1$ of the stepped section 212A. The exhaust gases defining the first recirculation zone $Z_1$ pass through the perforated plate 232, which is believed to function like a flow equalizer so as to dampen the flow structures defining the first recirculation zone $Z_1$ or flow field. That is, high velocity first flow structures of the first zone $Z_1$ have their velocities reduced by the plate or grid 232 whereas the lower velocity second flow structures of the first zone $Z_1$ have their velocities reduced much less. Hence, the first and second flow structures previously making up the first recirculation zone $Z_1$ define a more uniform combined flow field.

The plate 232 is preferably located axially downstream a distance $L_1$ from the stepped section 212A, where distance $L_1$ may equal approximately from about 2 to about 4 times the radial height $H_1$ of the stepped section 212A. Alternatively, it is contemplated that appropriate computer fluid dynamics simulation software may be provided for locating the perforated plate at a preferred location along the inner surface 324A of the outer wall first section 224A so as to maximize stabilization of the first recirculation zone $Z_1$. A preferred radial length of the plate 232 may be determined by computer fluid dynamics simulation software as well.

The second stabilizing structure 240 comprises a perforated plate or grid 242 extending radially from and circumferentially about the inner surface 324B of the outer wall second section 224B. The openings or perforations in the plate 242 may have a radial size of from about 5% to about 30% of a radial height $H_2$ of the stepped section 224C. It is believed that the exhaust gases circulating near the inner surface 324B and defining the second recirculation zone $Z_2$ pass through the perforated plate 242, which is believed to function like a flow equalizer so as to dampen the flow structures defining the second recirculation zone $Z_2$ or flow field. That is, high velocity first flow structures of the second zone $Z_2$ have their velocities reduced by the plate or grid 242 whereas the lower velocity second flow structures of the second zone $Z_2$ have their velocities reduced much less. Hence, the first and second flow structures previously making up the second recirculation zone $Z_2$ define a more uniform combined flow field.

The plate 242 is preferably located axially downstream a distance $L_2$ from the stepped section 224C, where distance $L_2$ may equal approximately from about 2 to about 4 times the radial height $H_2$ of the stepped section 224C. Alternatively, it is contemplated that appropriate computer fluid dynamics simulation software may be provided for locating the perforated plate at a preferred location along the inner surface 324B of the outer wall second section 224B so as to maximize stabilization of the second recirculation zone $Z_2$. A preferred radial length of the plate 242 may be determined by computer fluid dynamics simulation software as well.

It is believed that exhaust gases flowing through the passageway 236 will generate a third gas recirculation zone $Z_3$ or eddies downstream of the stepped section 222B of the inner wall 222. In the absence of the third stabilizing structure 250, it is believed that the third gas recirculation zone $Z_3$ may be unstable, i.e., it may increase and decrease in size axially, circumferentially and/or radially over time during operation of the turbine 12. Any oscillations and/or increase in the size of the third gas recirculation zone $Z_3$ may result in energy losses within the exhaust gases flowing through the passageway 236, thereby reducing the performance of the diffuser structure 220, i.e., the maximum pressure increase within the diffuser structure 220 is reduced or limited. As the diffuser structure performance decreases, the efficiency of the turbine 12 also decreases.

The third stabilizing structure 250 comprises first and second Helmholtz dampers 250A and 250B, each extending through the inner wall stepped section 222B and positioned near the third gas recirculation zone $Z_3$. It is contemplated that one or between about 3 and 20 Helmholtz dampers may be provided. Each Helmholtz damper 250A and 250B may comprise a box like resonator cavity which communicates with the passageway 236 via a damping tube which extends axially from the resonator cavity to the passageway 236. Exhaust gases pass through the damping tube and into the resonator cavity of the first Helmholtz damper 250A, where exhaust gas pressure oscillations or vibrations at or near a resonance frequency corresponding to the size of the resonator cavity of the damper 250A are reduced. Likewise, exhaust gases pass through the damping tube and into the resonator cavity of the second Helmholtz damper 250B, where exhaust gas pressure oscillations or vibrations at or near a resonance frequency corresponding to the size of the resonator cavity of the damper 250B are reduced. Hence, the resonator cavity of the first damper 250A may be sized differently from the resonator cavity of the second damper 250B so as to damp pressure oscillations at a different frequency from those damped by the second damper 250B. Accordingly, pressure oscillations at desired frequencies can be reduced by selecting Helmholtz dampers having appropriate resonator cavity sizes. The Helmholtz dampers 250A and 250B function to reduce the energy of a least a portion of the exhaust gases defining the third gas recirculation zone $Z_3$ and thereby stabilize, i.e., reduce the size and/or limiting changes in the size of the third gas recirculation zone $Z_3$ axially, circumferentially and/or radially during operation of the turbine 12.

It is also contemplated that one or more Helmholtz dampers may be provided in and extend through the stepped section 224C of the outer wall 224 and used in place of the perforated plate 242 to reduce the size and/or limit changes in the size of the second gas recirculation zone $Z_2$ axially, circumferentially and/or radially during operation of the turbine 12.

Figure 3:
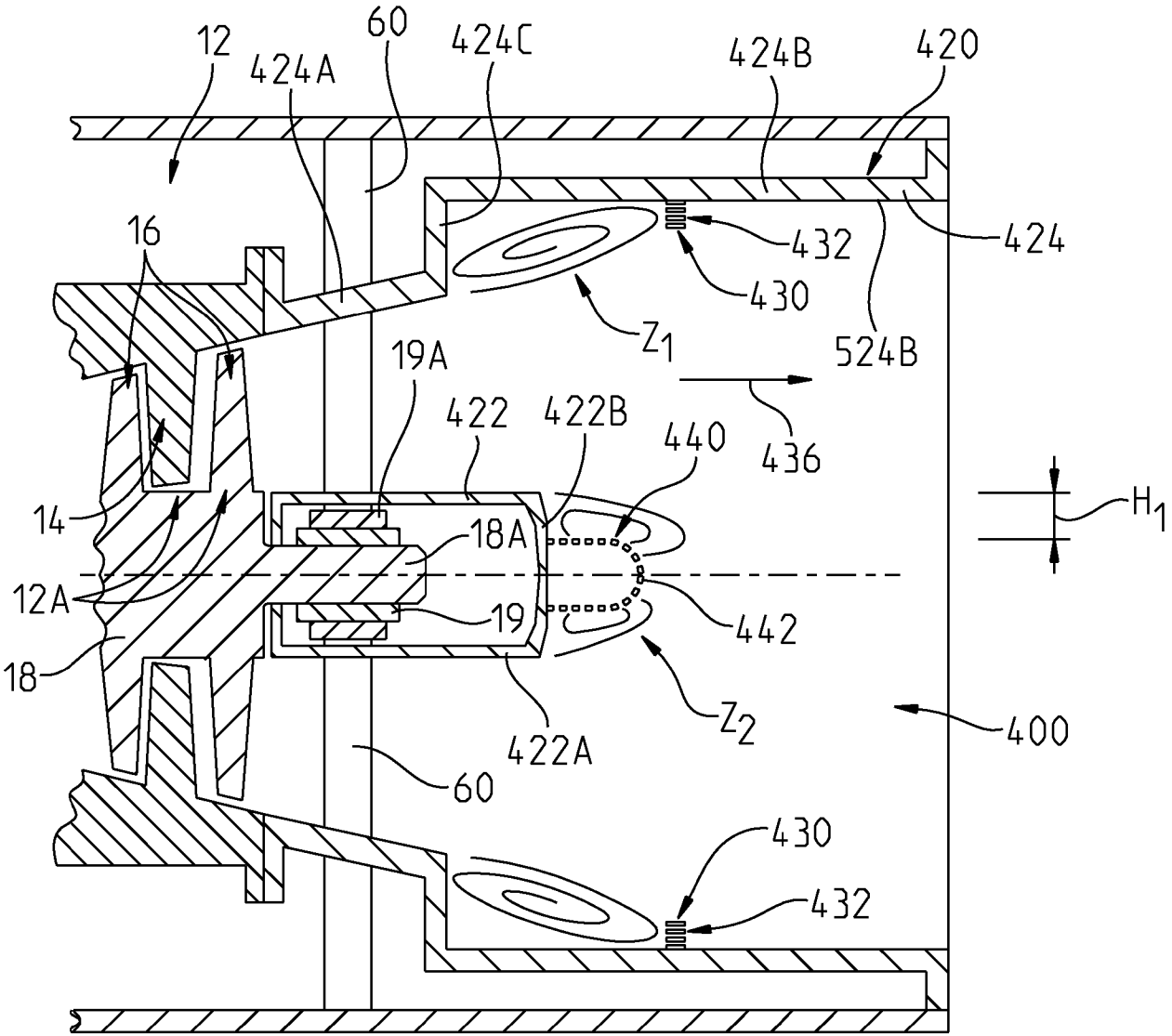
FIG. 3 is a schematic cross sectional view of a gas turbine engine including a diffuser apparatus constructed in accordance with a third embodiment of the present invention.

In accordance with a third embodiment of the present invention, illustrated in FIG. 3, a diffuser apparatus 400 is positioned downstream from the turbine last stage 12A. The diffuser apparatus 400 comprises a diffuser structure 420 and first and second stabilizing structures 430 and 440. The diffuser structure 420 includes inner and outer walls 422 and 424 defining a flow passageway 436 through which exhaust gases from the turbine 12 flow and diffuse. As the gases diffuse in the diffuser structure 420, their kinetic energy is reduced while the pressure of the gases increases. The outer wall 424 comprises first and second axial sections 424A and 424B and a stepped third section 424C joining the first and second axial sections 424A and 424B. The second axial section 424B has an inner diameter substantially larger than an inner diameter of the first section 424A. The inner wall 422 may comprise a first axial section 422A and a stepped section 422B located downstream from the first section 422A.

Because the outer wall second axial section 424B has an inner diameter that is substantially larger than an inner diameter of the outer wall first section 424A and the increase in diameter between the first and second sections 424A and 424B occurs over a very small axial distance at the third section 424C, it is believed that the exhaust gases flowing through the passageway 236 form a first gas recirculation zone $Z_1$ or eddies just downstream from the stepped section 424C of the outer wall 424. The first gas recirculation zone $Z_1$ or eddies may extend substantially circumferentially near an inner surface 524B of the second section 424B. It is also believed that the exhaust gas flow may separate from the inner surface 524B of the outer wall second section 424B at locations adjacent or near the gas recirculation zone $Z_1$. Limited or no diffusion of the exhaust gases may occur in regions of the diffuser structure 420 where the exhaust gas flow has separated from the inner surface 524B of the outer wall second section 424B, resulting in a reduction in efficiency of the turbine 12. In the absence of the first stabilizing structure 430, it is believed that the gas recirculation zone $Z_1$ may be unstable, i.e., it may increase and decrease in size axially, circumferentially and/or radially over time during operation of the turbine 12. Any increase in the size of the gas recirculation zone $Z_1$ may result in a corresponding increase in the amount of gas flow separation at the inner surface 524B of the outer wall second section 424B.

The first stabilizing structure 430 may comprises a perforated plate or grid 432 extending radially from and circumferentially about the inner surface 524B of the outer wall second section 424B. The openings or perforations in the plate 432 may have a radial size of from about 5% to about 30% of a radial height of the stepped section 424C. The exhaust gases circulating near the inner surface 524B and defining the first recirculation zone $Z_1$ pass through the perforated plate 432, which is believed to function like a flow equalizer so as to dampen the flow structures defining the first recirculation zone $Z_1$ or flow field. That is, high velocity first flow structures of the first zone $Z_1$ have their velocities reduced by the plate or grid 432 whereas the lower velocity second flow structures of the first zone $Z_1$ have their velocities reduced much less. Hence, the first and second flow structures previously making up the first recirculation zone $Z_1$ define a more uniform combined flow field.

The plate 432 is preferably located axially downstream a distance from the stepped section 424C, where the distance may equal approximately from about 2 to about 4 times a radial height of the stepped section 424C. Alternatively, it is contemplated that appropriate computer fluid dynamics simulation software may be provided for locating the perforated plate at a preferred location along the inner surface 524B of the outer wall second section 424B so as to maximize stabilization of the second recirculation zone $Z_1$. A preferred radial length of the plate 432 may be determined by computer fluid dynamics simulation software as well.

It is believed that exhaust gases flowing through the passageway 436 will generate a second gas recirculation zone $Z_2$ or eddies downstream of the stepped section 422B of the inner wall 422. In the absence of the second stabilizing structure 440, it is believed that the second gas recirculation zone $Z_2$ may be unstable, i.e., it may increase and decrease in size axially, circumferentially and/or radially over time during operation of the turbine 12. Any increase in the size of the second gas recirculation zone $Z_2$ may result in energy losses within the exhaust gases flowing through the passageway 436, thereby reducing the performance of the diffuser structure 420, i.e., the maximum pressure increase within the diffuser structure 420 is reduced or limited. As the diffuser structure performance decreases, the efficiency of the turbine 12 also decreases.

The second stabilizing structure 440 may comprises a perforated plate or grid 442 extending radially out from the stepped section 422B of the inner wall 422. In the illustrated embodiment, the plate 442 has a U-shaped cross section, as shown in FIG. 3, but may also have a rectangular, triangular or other like cross sectional shape. The openings or perforations in the plate 442 may have a radial size of from about 5% to about 30% of a radial height $H_1$ of the stepped section 422B, see FIG. 3. The exhaust gases defining the second recirculation zone $Z_2$ pass through the perforated plate 442, which is believed to function like a flow equalizer so as to dampen the flow structures defining the second recirculation zone $Z_2$ or flow field. That is, high velocity first flow structures of the second zone $Z_2$ have their velocities reduced by the plate or grid 442 whereas the lower velocity second flow structures of the second zone $Z_2$ have their velocities reduced much less. Hence, the first and second flow structures previously making up the second recirculation zone $Z_2$ define a more uniform combined flow field.

Figure 4:
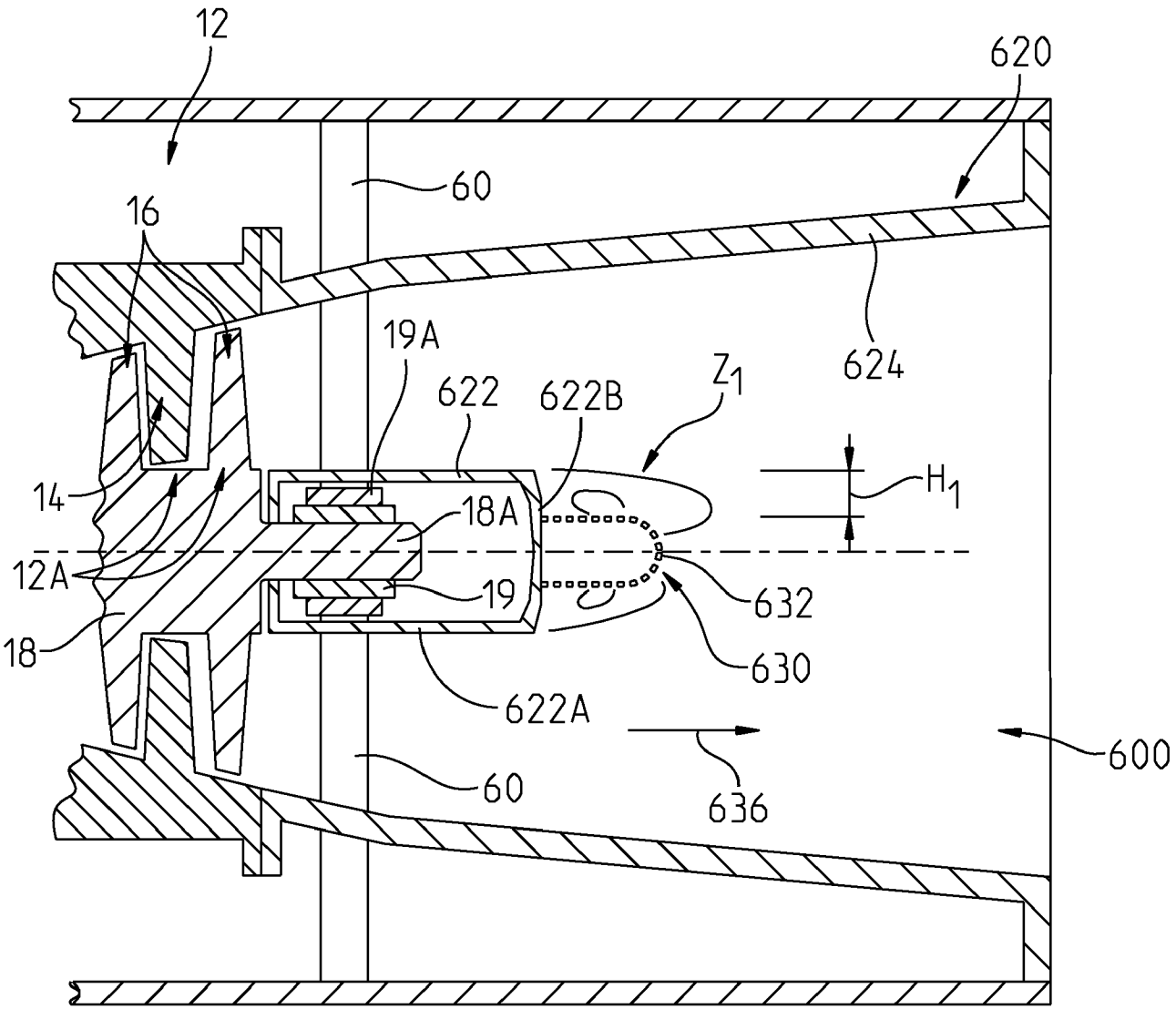
FIG. 4 is a schematic cross sectional view of a gas turbine engine including a diffuser apparatus constructed in accordance with a fourth embodiment of the present invention.

In accordance with a fourth embodiment of the present invention, illustrated in FIG. 4, a diffuser apparatus 600 is positioned downstream from the turbine last stage 12A. The diffuser apparatus 600 comprises a diffuser structure 620 and a first stabilizing structure 630. The diffuser structure 620 includes inner and outer walls 622 and 624 defining a flow passageway 636 through which exhaust gases from the turbine 12 flow and diffuse. As the gases diffuse in the diffuser structure 620, their kinetic energy is reduced while the pressure of the gases increases. The outer wall 424 diverges gradually outwardly in a direction away from the turbine 12 and is not stepped. The inner wall 622 may comprise a first axial section 622A and a stepped section 622B located downstream from the first section 622A.

It is believed that exhaust gases flowing through the passageway 636 will generate a first gas recirculation zone $Z_1$ or eddies downstream of the stepped section 622B of the inner wall 622. In the absence of the first stabilizing structure 630, it is believed that the first gas recirculation zone $Z_1$ may be unstable, i.e., it may increase and decrease in size axially, circumferentially and/or radially over time during operation of the turbine 12. Any increase in the size of the first gas recirculation zone $Z_1$ may result in energy losses within the exhaust gases flowing through the passageway 636, thereby reducing the performance of the diffuser structure 620, i.e., the maximum pressure increase within the diffuser structure 620 is reduced or limited. As the diffuser structure performance decreases, the efficiency of the turbine 12 also decreases.

The first stabilizing structure 630 may comprise a perforated plate or grid 632 extending axially out from the stepped section 622B of the inner wall 622. In the illustrated embodiment, the plate 632 has a U-shaped cross section, as shown in FIG. 4. The openings or perforations in the plate 632 may have a radial or axial size of from about 5% to about 30% of a radial height $H_1$ of the stepped section 622B, see FIG. 4. It is believed that the exhaust gases defining the first recirculation zone $Z_1$ pass completely or partially through the perforated plate 632, which is believed to function like a flow equalizer so as to dampen the flow structures defining the first recirculation zone $Z_1$ or flow field. That is, high velocity first flow structures of the first zone $Z_1$ have their velocities reduced by the plate or grid 632 whereas the lower velocity second flow structures of the first zone $Z_1$ have their velocities reduced much less. Hence, the first and second flow structures previously making up the first recirculation zone $Z_1$ define a more uniform combined flow field.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A diffuser apparatus in a turbomachine comprising:

a diffuser structure having inner and outer walls defining a flow passageway through which gases flow and diffuse such that kinetic energy is reduced and pressure is increased in the gases as they move through said passageway, said outer wall having first and second axial sections and a stepped section joining said first and second axial sections; and first stabilizing structure positioned downstream from said stepped section of said outer wall to stabilize a separated gas recirculation zone located downstream from said outer wall stepped section.

2. The diffuser apparatus as set out in claim 1, wherein said stabilizing structure comprises a perforated plate extending radially from and circumferentially about said outer wall and positioned downstream from said outer wall stepped section to stabilize the separated gas recirculation zone located downstream from said outer wall stepped section.

3. The diffuser apparatus as set out in claim 1, wherein said stabilizing structure comprises at least one suction tube extending through said outer wall and communicating with an area of said passageway downstream from said outer wall stepped section such that the separated gas recirculation zone located downstream from said outer wall stepped section is stabilized.

4. The diffuser apparatus as set out in claim 3, wherein the diffuser structure further comprises at least one strut extending between said inner and outer walls of said diffuser structure and wherein said at least one suction tube communicates with an area downstream from said at least one strut such that high velocity gases downstream from said at least one strut generate a suction in said at least one suction tube.

5. The diffuser apparatus as set out in claim 1, wherein said outer wall second axial section has an inner diameter greater than an inner diameter of said outer wall first axial section.

6. The diffuser apparatus as set out in claim 1, wherein said inner wall comprises a first axial section and a stepped section located downstream from said first section.

7. The diffuser apparatus as set out in claim 6, further comprising second stabilizing structure associated with said inner wall stepped section to stabilize a separated gas recirculation zone located downstream from said inner wall stepped section.

8. The diffuser apparatus as set out in claim 7, wherein said second stabilizing structure comprises a perforated plate positioned adjacent to said inner wall stepped section to stabilize the separated gas recirculation zone located downstream from said inner wall stepped section.

9. The diffuser apparatus as set out in claim 7, wherein said second stabilizing structure comprises at least one Helmholtz damper associated with said inner wall stepped section to stabilize the separated gas recirculation zone located downstream from said inner wall stepped section.

10. A diffuser apparatus in a turbomachine comprising:

a diffuser structure having inner and outer walls defining a flow passageway through which gases flow and diffuse such that kinetic energy is reduced and pressure is increased in the gases as they move through said passageway, said inner wall having a first axial section and a stepped section located downstream from said first section; and stabilizing structure associated with said stepped section to stabilize a separated gas recirculation zone located downstream from said stepped section.

11. The diffuser apparatus as set out in claim 10, wherein said stabilizing structure comprises a perforated plate positioned adjacent to said stepped section to stabilize the separated gas recirculation zone located downstream from said stepped section.

12. The diffuser apparatus as set out in claim 11, wherein said stabilizing structure comprises at least one Helmholtz damper associated with said stepped section to stabilize the separated gas recirculation zone located downstream from said stepped section.

13. The diffuser apparatus as set out in claim 11, wherein said outer wall comprises first and second axial sections and a stepped section joining said first and second axial sections.

14. The diffuser apparatus as set out in claim 13, wherein said outer wall second axial section has an inner diameter greater than an inner diameter of said outer wall first axial section.

15. A diffuser apparatus in a turbomachine comprising:

a diffuser structure having inner and outer walls defining a flow passageway through which gases flow and diffuse such that kinetic energy is reduced and pressure is increased in the gases as they move through said passageway, said outer wall having first and second axial sections and a stepped section joining said first and second axial sections; and stabilizing structure associated with said stepped section of said outer wall to stabilize a separated gas recirculation zone located downstream from said outer wall stepped section.

16. The diffuser apparatus as set out in claim 15, wherein said stabilizing structure comprises at least one Helmholtz damper associated with said stepped section to stabilize the separated gas recirculation zone located downstream from said stepped section.

17. The diffuser apparatus as set out in claim 1, wherein said flow passageway defined by said inner and outer walls of said diffuser structure receives said gases directly from an array of rotating blades of a last stage in a turbine of the turbomachine, the last stage including the array of rotating blades and an array of stationary vanes upstream from the blades.

18. The diffuser apparatus as set out in claim 1, wherein the first and second axial sections of the outer wall each define a portion of the passageway.

19. The diffuser apparatus as set out in claim 10, wherein said flow passageway defined by said inner and outer walls of said diffuser structure receives said gases directly from an array of rotating blades of a last stage in a turbine of the turbomachine, the last stage including the array of rotating blades and an array of stationary vanes upstream from the blades.

20. The diffuser apparatus as set out in claim 15, wherein said flow passageway defined by said inner and outer walls of said diffuser structure receives said gases directly from an array of rotating blades of a last stage in a turbine of the turbomachine, the last stage including the array of rotating blades and an array of stationary vanes upstream from the blades.

* * * * *